United States Patent [19]

McDonald

[11] 4,253,903

[45] Mar. 3, 1981

[54] CORRUGATING MACHINE WITH AIR PRESSURE CLEANING DEVICE FOR GLUE ROLLER GROOVES

[75] Inventor: William V. McDonald, Fort Worth, Tex.

[73] Assignee: Bates Container Corporation, Fort Worth, Tex. ; a part interest

[21] Appl. No.: 82,784

[22] Filed: Oct. 9, 1979

[51] Int. Cl.[3] ..... B05C 1/00; B31F 1/20

[52] U.S. Cl. ..... 156/389; 15/405; 118/203; 156/462; 156/473

[58] Field of Search ..... 156/463–470, 156/529, 535, 472, 473, 389, 462; 15/300 R, 303, 405, 422, 415 R; 29/81 K; 118/203; 134/104

[56] References Cited

U.S. PATENT DOCUMENTS

| | | | |
|---|---|---|---|
| 1,629,511 | 5/1927 | Kramer | 156/472 |
| 1,812,942 | 7/1931 | Gaines | 15/405 |
| 2,018,240 | 10/1935 | Swift, Jr. | 156/473 |
| 2,252,204 | 8/1941 | Reilly | 118/203 |
| 2,445,135 | 7/1948 | Curtis, Jr. | 118/203 |
| 2,554,035 | 5/1951 | Kreyling | 156/389 |
| 2,589,966 | 3/1952 | Rullo | 156/472 |
| 3,682,744 | 8/1972 | Person | 156/389 |
| 3,994,768 | 11/1976 | Roberts | 118/203 |

*Primary Examiner*—Paul J. Thibodeau
*Attorney, Agent, or Firm*—James E. Bradley

[57] ABSTRACT

A paper corrugating machine has features for cleaning the glue from the grooves of the glue roller. The corrugating machine is of a type having upper and lower intermeshing corrugating rollers that receive a first web of paper between them. Fingers located near the lower corrugating roller retain the web in engagement with the lower corrugating roller after it has been corrugated. A glue roller applies glue to the corrugated web at this point. The glue roller has grooves to accommodate the retaining fingers. An air jet nozzle is mounted above each groove for discharging air into the grooves to remove excess glue prior to contacting the retaining fingers. The nozzles are adjustable in their positioning and have cleaning devices for cleaning them while the machine remains in operation.

6 Claims, 4 Drawing Figures

CORRUGATING MACHINE WITH AIR PRESSURE CLEANING DEVICE FOR GLUE ROLLER GROOVES

BACKGROUND OF THE INVENTION

1. Field of the Invention

This invention relates in general to machinery for making corrugated paper, and in particular to an air pressure cleaning device for glue roller grooves.

2. Description of the Prior Art

Corrugated paper is a relatively stiff, heavy paper, used in cardboard boxes and the like. This type of paper has a layer of corrugated paper bonded to smooth layers of paper on each side.

In one machine for performing the corrugation, an upper corrugating roller, with corrugations on a cylindrical surface, intermeshes with a lower corrugating roller. A web of paper is fed between them, being corrugated as it passes through them. After corrugating, the corrugated web proceeds more than halfway around the lower corrugating roller. To keep the corrugations of the paper located within the corrugations in the lower corrugating roller, a plurality of curved fingers are mounted next to the lower corrugating roller. A glue roller contacts the corrugated paper at this point to apply glue. Circumferential grooves are formed in the glue roller to accomodate the fingers. A pressure roller receives a second web and presses it to the corrugated web after the corrugated web has received the glue.

Glue is applied to the glue roller by partially submerging the glue roller in a pan of glue. As a result, the glue gets into the grooves. This glue tends to build up on the fingers, causing detritus to collect on the fingers. This may result in wide dry streaks on the corrugated paper where no glue is placed. The wide dry streaks may cause the paper to break along that line. Consequently, build up of detritus must be controlled.

In the prior art, glue is cleaned from the grooves by a second set of fingers mounted in the grooves of the glue roller. These glue roller fingers, are thin metal members inserted into the grooves immediately above the glue pan. They wipe the glue from the grooves prior to the retaining fingers.

One disadvantage of the glue roller fingers is that they wear since they are located in sliding contact with the grooves. They must be changed periodically, this procedure being costly and time consuming. Also, the glue roller fingers tend to pick up detritus that cannot be easily removed. If unchecked, too much of the glue will be wiped from the grooves, leaving an undesirable wide streak on the paper.

SUMMARY OF THE INVENTION

It is accordingly the general object of this invention to provide an improved paper corrugating machine.

It is a further object of this invention to provide an improved means for cleaning the grooves on the glue roller of a paper corrugating machine.

It is a further object of this invention to provide an improved means for cleaning the grooves on the glue roller of a paper corrugating machine in a manner that minimizes the width of the dry streaks.

In accordance with these objects, a plurality of nozzles are mounted adjacent the glue roller, each nozzle pointing into one of the grooves. Air pressure is supplied to each nozzle to remove glue from the grooves. The nozzles replace the glue roller fingers. The nozzles are mounted to an adjustable bracket that allows the distance from the nozzle to the groove to be varied, as well as the inclination of the nozzle. Also, each nozzle has a cleanout device, that preferably includes a needle and plunger, to allow the nozzles to be cleaned while the machine is in operation.

DESCRIPTION OF THE PREFERRED EMBODIMENT

Figure 1:
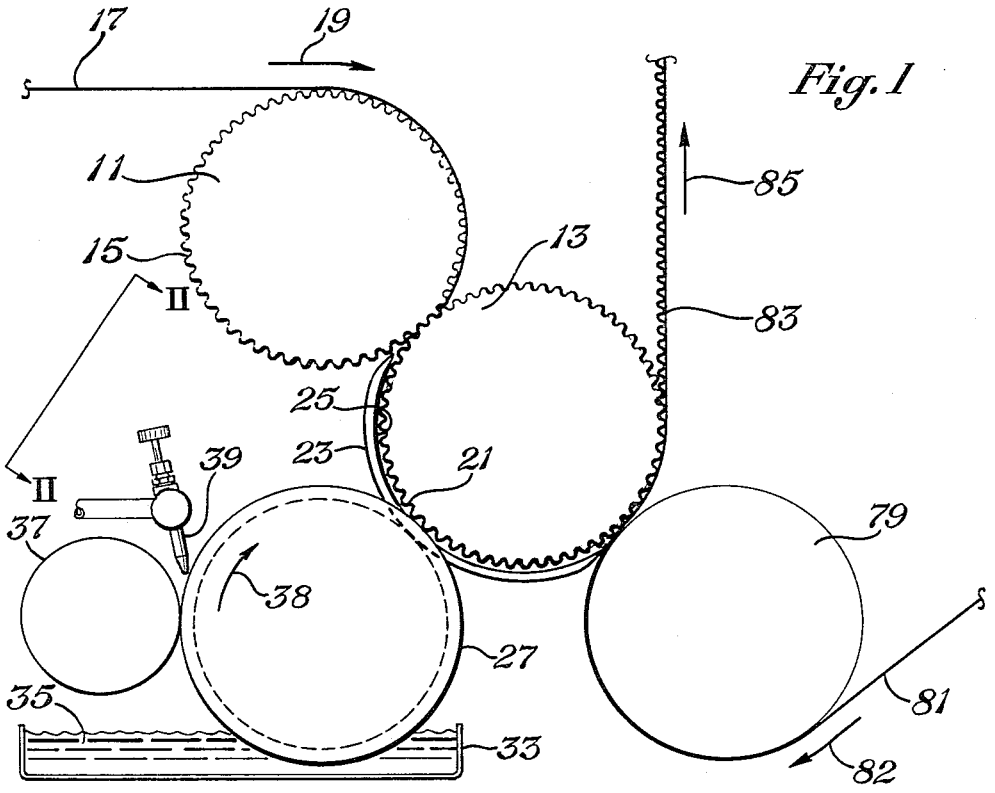
FIG. 1 is a schematic side elevational view illustrating a corrugating machine constructed in accordance with this invention.

Referring to FIG. 1, a corrugating machine is shown, including an upper corrugating roller 11 in intermeshing engagement with a lower corrugating roller 13. Both corrugating rollers 11, 13 are relatively wide drums having a cylindrical outer surface containing splines, flutes, or corrugations 15 that are parallel with the axis of rotation. Corrugating rollers 11 and 13 are of the same width, the same diameter, and have the same pitch for their corrugations 15, for intermeshing engagement, as indicated. A first web of paper 17, substantially the width of the corrugating rollers 11, 13, is drawn over the upper corrugating roller 11. As shown by arrow 19, web 17 passes between the corrugating rollers 11, 13 for forming corrugations, then extends about three-fourths of the way around the lower corrugating roller 13. Although upper corrugating roller 11 is in fact above lower roller 13, the word "upper" herein refers to the corrugating roller that first contacts the web 17 for corrugating, since the relative positions of the rollers 11, 13 may be varied.

Immediately after corrugating, the web 17 must stay in engagement with the corrugations 15 on the lower corrugating roller 13. The corrugations on web 17 are indicated by numeral 21. To maintain the corrugations 21 in registering engagement with corrugations 15, a plurality of fingers 23 are mounted adjacent lower corrugating roller 13. As shown also in FIG. 2, the retaining fingers 23 are evenly spaced a few inches apart, for preventing the paper corrugations 21 from jumping out of the lower roller corrugations 15. Each finger 23 is a thin, metal member having a curved inner edge 25 that contacts the corrugations 21. The outer edge of each finger 23 is also preferably circular. The fingers 23 extend around substantially one-half the circumference of the lower corrugating roller 13.

Figure 2:
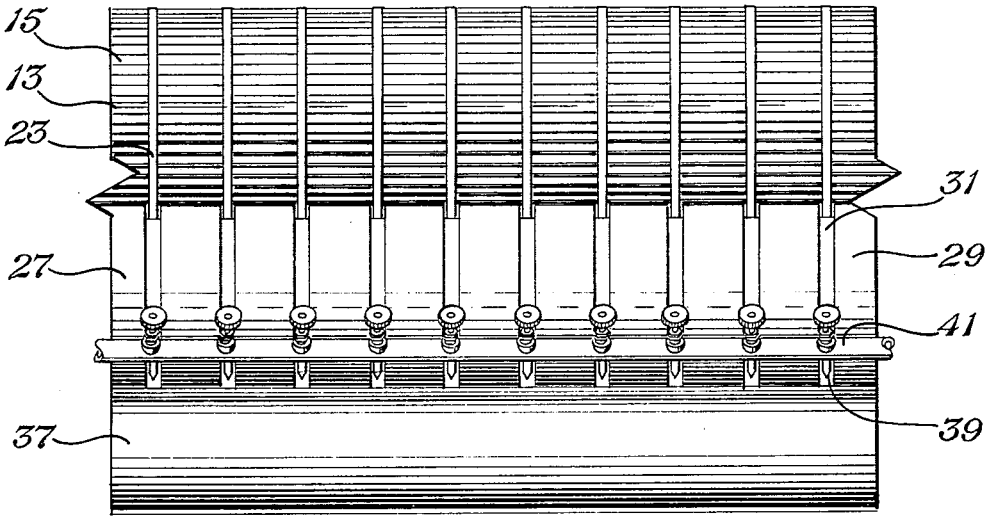
FIG. 2 is a partial view of the corrugating machine of FIG. 1, shown as seen from the line II—II of FIG. 1, but with the webs of paper not shown.

A cylindrical glue roller 27 is mounted adjacent the lower corrugating roller 13 for applying glue to the paper corrugations 21. Glue roller 27 is cylindrical with a plurality of smooth cylindrical bands 29 on its outer surface for contacting the paper corrugations 21, as shown in FIG. 2. The bands 29 are separated by a plurality of circumferential grooves 31 formed about one inch deep in the outer cylindrical surface of the glue roller 27. Grooves 31 are spaced apart the same distance as the fingers 23, each receiving a portion of a finger 23.

Each groove 31 is only slightly larger in width than the width of a finger 23.

Glue roller 27 is driven as indicated by arrow 38, and partially submerged in a pan 33 containing glue 35. A smaller metering or doctor roller 37 is mounted adjacent the glue roller 27. Although the rollers 27 and 37 appear to contact in the drawing, there is actually a very small clearance between them. Doctor roller 37 is driven in the same direction as glue roller 27, but the surface velocities differ, causing the doctor roller to wipe off a portion of and even the layer of glue from the glue roller 27. Doctor roller 37 is smoothly cylindrical and is wiped clean by a rubber strip (not shown) prior to its wiping engagement with glue roller 27.

As shown in FIG. 1, a plurality of nozzles 39 are mounted above glue roller 27 after a point has received glue 35, has been wiped by doctor roller 37, but before it contacts the paper corrugations 21. Referring to FIG. 2, a nozzle 39 is located above each groove 31 in the glue roller 27 and slightly above the wiping engagement of glue roller 27 with doctor roller 37. Each nozzle 39 is mounted on a manifold 41 that is supplied with air pressure by a source (not shown).

Figure 3:
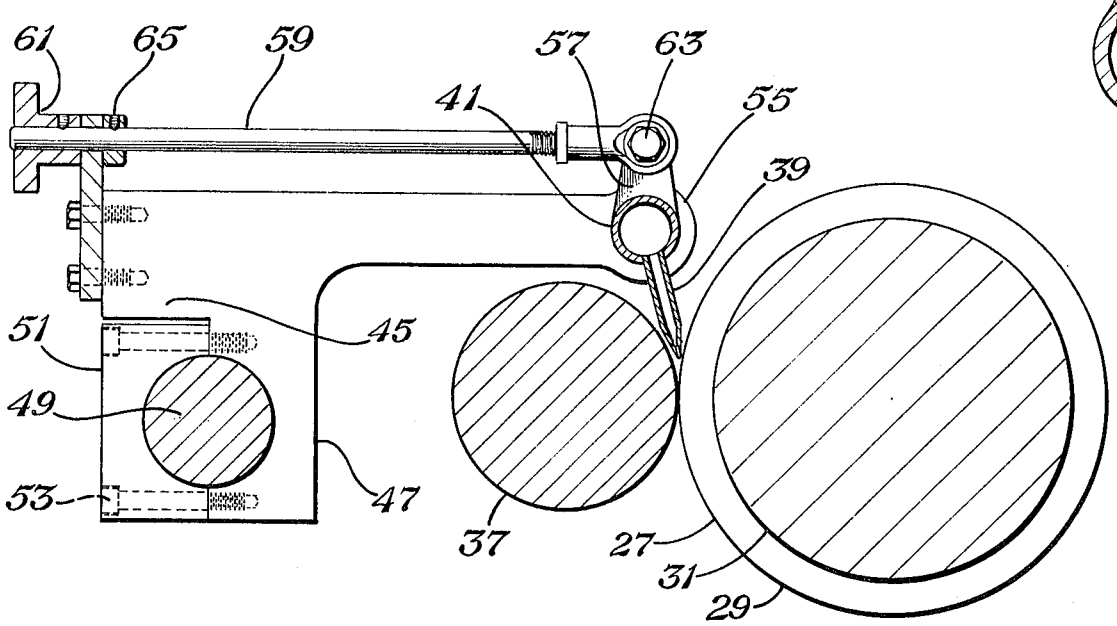
FIG. 3 is a vertical sectional view of part of the corrugating machine of FIG. 1, shown enlarged and with further detail.

Referring to FIG. 3, each nozzle 39 comprises a tube extending radially from manifold 41, which is cylindrical and has its axis parallel to the axis of rotation of rollers 11 and 13. Manifold 41 is rotatably carried between a pair of spaced apart brackets 45 (only one shown). Each bracket 45 is generally L-shaped, with a vertical base portion 47 mounted to a cylindrical bar 49. A clamp 51, secured by bolts 53, allows the base portion 47 to be oriented at different positions. Manifold 41 is rotatably carried at the ends of a cantilevered portion 55, which extends over the doctor roller 37. Rotating bracket 45 around bar 49 a selected increment changes the distance from the cantilevered end 55 to the glue roller 27.

Manifold 41 also has one or more lever arms 57 rigidly secured to it, perpendicular to the axis of manifold 41. For each lever arm 57, a rod 59 is slidably carried on its first end by a sleeve 61 opposite the bracket cantilevered end 55. Its second end is connected by a pivotal connection 63 to the lever arm 57. Releasing set screws 65 and sliding arm 59 longitudinally a selected distance rotates the lever arm 57 and manifold 41, thus changing the direction that nozzle 39 points.

Figure 4:
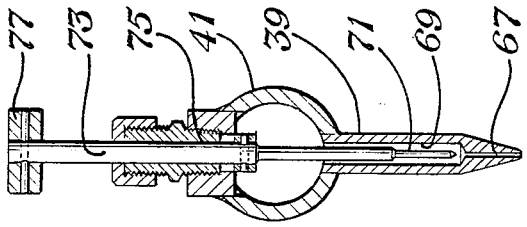
FIG. 4 is an enlarged vertical sectional view of one of the nozzles shown in the figures.

As shown in FIG. 4, each nozzle 39 contains a clean-out means for cleaning the tips of the nozzles 39 while the corrugating machine is in continuous operation. Each nozzle 39 has an axial passage with a reduced portion 67 at its outlet and an enlarged inlet portion 69 extending from the reduced portion to manifold 41. A needle 71 is carried in the nozzle 39 by a plunger 73 that is reciprocally and sealingly carried in manifold 41 by seal 75. A disk 77 at its top allows the plunger 73 to be manually reciprocated between an upper position, as shown in FIG. 4, and a lower position in which the needle protrudes out the end of the reduced portion 67. Needle 71 is substantially the diameter of the reduced portion 67 for close reception. Needle 71 is considerably lesser in diameter than the enlarged portion 69, to allow air to pass around the needle while it is in the upper position, as shown in FIG. 4. The lengths of the plunger 73 and the needle 71 are selected so that when moved to the cleaning or lower position, it will protrude through the outlet of the reduced portion 67. The portion of the plunger 73 immediately above needle 71 is also of lesser diameter than the enlarged portion 69, to allow air to pass through the passage portions 67 and 69 while in the upper position.

Referring to FIG. 1, a pressure roller 79 is mounted adjacent the lower corrugating roller 13 directly opposite from the point that the lower corrugating roller 13 engages the upper corrugating roller 11. Pressure roller 79 has a smooth cylindrical surface over which is received a second web 81 of paper proceeding in the direction indicated by arrow 82. Pressure roller 79 is positioned so as to press web 81 into contact with the corrugations 21 of web 17, after glue has been applied. The single bounded web, exiting from the lower corrugating roller 13 is indicated by numeral 83. Web 83 exits vertically, or 90° from the incoming web 17, as indicated by the arrow 85.

In operation, first web 17 is drawn over upper corrugating roller 11. Web 17 passes between the upper corrugating roller 11 and the lower corrugating roller 13, being corrugated by the corrugations 15 on the corrugating rollers 11 and 13. The corrugated paper 21 stays in engagement with corrugations 15 of the lower corrugating roller 13, being retained by fingers 23. At a point about 90 degrees rotationally from the point that web 17 is corrugated, glue is applied by glue roller 27, which picks up glue 35 from pan 33. Doctor roller 37 limits the amount of glue picked up. Air is supplied through manifold 41 at pressures typically between 5 and 50 pounds per square inch. Nozzles 39 discharge air into the grooves 31, removing or blowing glue from the grooves 31 prior to contact with fingers 23, as shown in FIG. 2. The discharge of air does not dry the remaining glue in the grooves 31 due to the constant rotation through the glue pan 33. Second web 81 is drawn over pressure roller 79 and bonded to the corrugations 21 at a point about 180 rotational degrees from the point that web 17 is corrugated.

The resulting web 83 has a smooth layer of paper on one side, and corrugations 21 on the other side. Subsequently, a second layer of paper is applied to the corrugations 21 on the opposite side, to create smooth surfaces on both sides, with corrugations 21 disposed between. All of the rollers will be maintained at about 350° F.

The air jets discharged through nozzles 39 are adjusted to avoid glue and detritus build up on fingers 23, and also to avoid having too wide of a dry streak by cleaning too much glue from grooves 31. The nozzles 39 do not necessarily remove all of the glue from the grooves. If properly adjusted, the amount of glue remaining will be sufficient to create a dry streak that is very thin, or even non-existent in some cases. This adjustment depends on many factors, including speeds, air pressure, types of glue, and can be determined by slightly moving the nozzles 39 and varying the air pressure until the optimum position is reached for the particular corrugating machine.

To adjust the nozzles 39 to vary the distance from the grooves 31, bolts 53 are loosened and bracket 45 rotated about bar 49 until the desired distance is achieved. In FIG. 3, the cantilevered portion 55 of bracket 45 is substantially horizontal and the tip of nozzle 39 is located substantially at the cylindrical bands 29 on the glue roller 27. Nozzle 39 is shown discharging along a line that is about halfway between the base or inner diameter of groove 31 and the cylindrical band 29. To adjust the orientation of nozzles 39 so that they discharges at a different angle with respect to grooves 31, set screws 65 are loosened and rod 59 moved longitudinally to rotate the manifold 41. In this way, the nozzles 39 can be adjusted to discharge along an infinite number of lines with respect to the grooves 31.

In operation, glue may accumulate on the tips of the nozzles 39, along with detritus from the paper. To clean the nozzles while the machine continuously operates, the operator presses disk 77 to move the plunger 73 from the upper position, as shown in FIG. 4, to the lower position. The needle 71 will protrude through the passage reduced portion 67 and clean the tip of any glue and detritus. The operator then pulls the plunger back. Air pressure to the particular groove 31 will be cut off only for the moment that the needle 71 is located in the reduced portion 67.

The manifold 41 and a compressor (not shown), serve as air pressure means for supplying air to the nozzles to remove glue from the grooves. The disk 77, and plunger 73 serve as means for manually moving the needle 71 between the upper and lower positions to clean the tip. Bracket 45 and rod 59, and their associated connecting members, serve as mounting means for mounting the nozzles so as to allow them to be positioned at selected angles with respect to the grooves and at selected distances from the grooves, to achieve optimum glue removal.

It should be apparent that an invention having significant advantages has been provided. The nozzles eliminate the need for metal cleanout fingers in the grooves. This avoids having to periodically replace the fingers and also avoids the problem of detritus catching on the fingers. The adjustability of the nozzles allows an optimum to be reached wherein the proper amount of glue is blown from the grooves so as to achieve a minimum width dry streak on the corrugated paper. The nozzles can be easily cleaned without interrupting the operation of the corrugating machine.

While the invention has been shown in only one of its forms, it should be apparent to those skilled in the art that it is not so limited, but is susceptible to various changes and modifications thereof.

I claim:

1. An apparatus for removing glue from circumferential grooves of a glue roller in a machine for making corrugated paper, comprising:

a plurality of nozzles mounted adjacent the glue rollers, each pointing into one of the grooves; and air pressure means for supplying air to the nozzles to remove glue from the grooves, the air pressure means comprising:

a manifold connected to a source of air pressure, each nozzle being connected to the manifold, and wherein the apparatus further comprises;

a needle for each nozzle reciprocally carried by the manifold between an upper and lower position, the needle being positioned and being of length for protruding through the nozzle when in the lower position to clean the tube; and a plunger secured to the upper end of each needle and extending sealingly out of the manifold for enabling the needles to be manually reciprocated to clean the nozzles.

2. The apparatus according to claim 1 further comprising:

mounting means for mounting the nozzles so as to allow the nozzles to be positioned at selected angles with respect to the grooves and at selected distances from the grooves to achieve optimum glue removal.

3. The apparatus according to claim 2 wherein the mounting means comprises:

a bracket mounted to a cylindrical bar at a first end by a clamp;

the manifold being rotatably carried by the second end of the bracket;

a lever arm rigidly secured to the manifold; and a rod having a first end slidably secured to the first end of the bracket and a second end pivotally secured to the lever arm, so that longitudinal movement of the rod pivots each nozzle with respect to each groove, rotation of the bracket around the cylindrical bar changing the distance from each nozzle to each groove.

4. In a corrugating machine of the type having upper and lower intermeshing corrugating rollers for receiving a first web of paper between them, a plurality of fingers for retaining the first web of paper in engagement with the lower corrugating roller, a glue roller for applying glue to the first web of paper after corrugation, the glue roller having a plurality of grooves, each receiving one of the fingers, and a pressure roller for pressing a second web of paper to the first web of paper after glue has been applied, the improvement comprising:

a plurality of nozzles mounted adjacent the glue rollers, each pointing into one of the grooves, said nozzles being provided with clean-out means for cleaning the tips thereof; and air pressure means for supplying air to the nozzles to remove glue from the grooves.

5. The apparatus according to claim 4, further comprising:

mounting means for mounting the nozzles so as to allow the nozzles to be selectively oriented with respect to the grooves, and for selecting the distance from the nozzles to the grooves.

6. In a corrugating machine of the type having upper and lower intermeshing corrugating rollers for receiving a first web of paper between them, a plurality of fingers for retaining the first web of paper in engagement with the lower corrugating roller, a glue roller for applying glue to the first web of paper after corrugation, the glue roller having a plurality of grooves, each receiving one of the fingers, and a pressure roller for pressing a second web of paper to the first web of paper after glue has been applied, the improvement comprising:

a bracket mounted adjacent the glue roller;

a manifold rotatably carried by the bracket parallel with the axis of the glue roller, the manifold being in communication with a source of air pressure;

a plurality of nozzles extending downward from the manifold, each nozzle pointing generally into one of the grooves for cleaning glue from the groove by the discharge of air, each nozzle having an axial passage with an outlet portion of lesser diameter than an inlet portion;

a needle reciprocally carried in the nozzle between an upper and a lower position, the needle being of a diameter for close reception in the outlet portion and of a length for protruding through the outlet portion when in the lower position to clean the nozzle, the needle being of lesser diameter than the inlet portion and being carried in the inlet portion when in the upper position, to allow the discharge of air through the nozzle; and a plunger secured to the upper end of the needle and extending sealingly out of the manifold, for enabling the needle to be manually reciprocated to clean the nozzle.

* * * * *